United States Patent [19]

Grinde et al.

[11] Patent Number: 4,836,123

[45] Date of Patent: Jun. 6, 1989

[54] COMPACT MOTOR/GENERATOR SET FOR PROVIDING ALTERNATING CURRENT POWER TO A MARINE CRAFT

[75] Inventors: James E. Grinde, Anoka, Minn.; Kazuo Kuroda, Iwata, Japan

[73] Assignees: Yamaha Hatsudoki Kabushiki Kaisha; Sanshin Kogyo Kabushiki Kaisha, both of Japan

[21] Appl. No.: 178,534

[22] Filed: Apr. 7, 1988

[51] Int. Cl.[4] ..... B63B 35/00

[52] U.S. Cl. ..... 114/270; 440/3; 440/6; 440/113

[58] Field of Search ..... 440/3, 6, 113, 900; 114/270, 343; 290/4 R, 17, 43, 46, 53, 54; 310/67 R, 75 R, 254; 123/149 R

[56] References Cited

U.S. PATENT DOCUMENTS

| | | | |
|---|---|---|---|
| 3,230,698 | 1/1966 | Nettles | 440/3 |
| 4,545,559 | 10/1985 | Gilbreath | 440/900 |
| 4,723,928 | 2/1988 | Riley | 440/900 |

*Primary Examiner*—Joseph F. Peters, Jr.
*Assistant Examiner*—Jesûs D. Sotelo
*Attorney, Agent, or Firm*—Orrin M. Haugen; Thomas J. Nikolai; Frederick W. Niebuhr

[57] ABSTRACT

Contained within a splash water impervious housing and secured to a shock-mounted equipment support plate are an internal combustion engine, a water pump and a generator, each with a vertically-oriented shaft. Also disposed on the support plate immediately adjacent the engine's exhaust manifold is a water-cooled muffler. Combustion air for the engine and cooling air for the generator is drawn into the housing through a labyrinthian passage, which is effective to block the entry of splash water into the enclosure defined by the housing. The water pump and generator are driven by the engine with the water pump delivering cooling water to the engine's oil pan and cylinder block as well as to the muffler. The heated water is then discharged with the engine's exhaust through the muffler. Because of the cooling system employed, the engine, generator, water pump, muffler and the controls therefor can be compactly positioned relative to one another within the water-tight shroud, allowing the motor/generator set to be mounted exterior to the hull of the marine carft on its swim platform or, alternatively, in a bilge area where space is at a premium.

24 Claims, 5 Drawing Sheets

Fig. 1
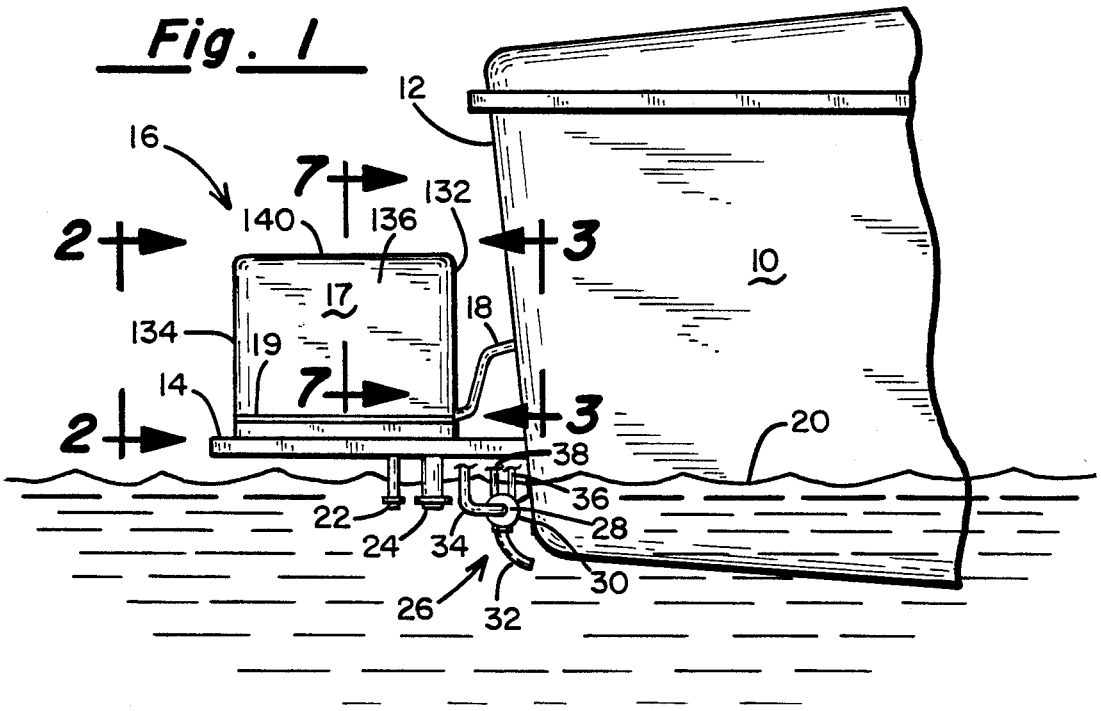
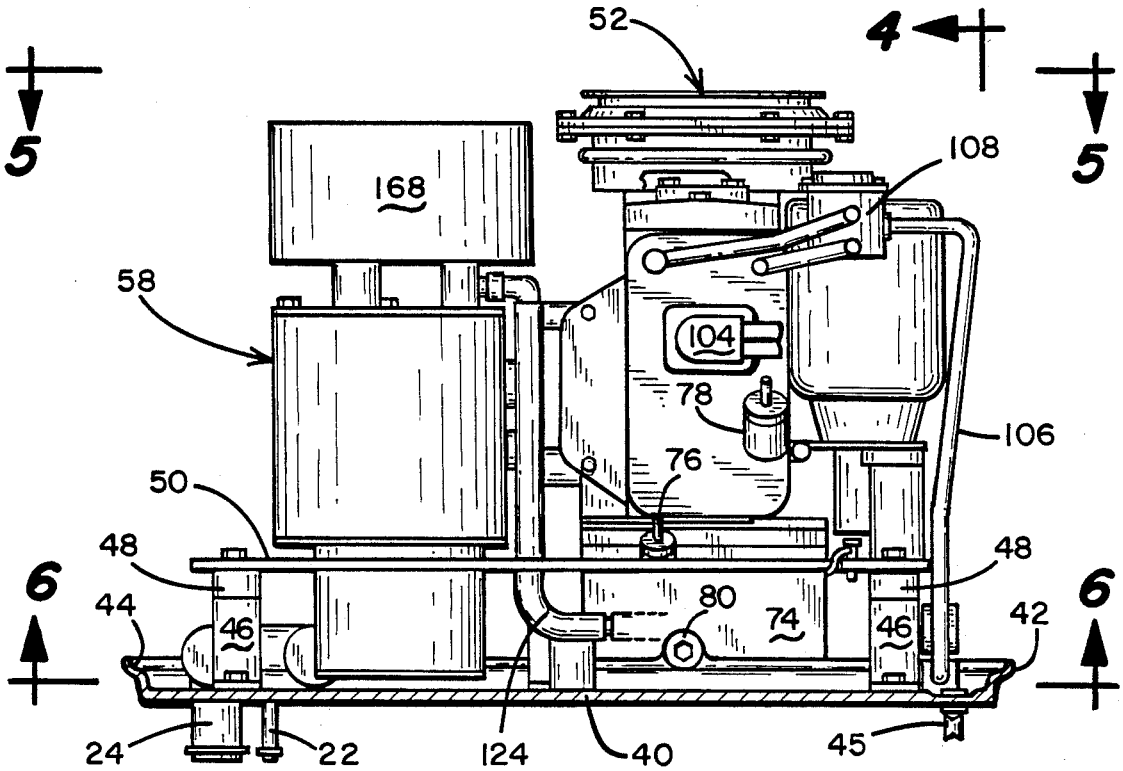
Fig. 2

COMPACT MOTOR/GENERATOR SET FOR PROVIDING ALTERNATING CURRENT POWER TO A MARINE CRAFT

BACKGROUND OF THE INVENTION

I. Field of the Invention: This invention relates generally to a compact alternating current power supply, and more particularly to a motor/generator set, especially designed for marine use on craft of small to intermediate size, and which is easy to install, maintain and repair.

II. Discussion of the Art: So that boating enthusiasts can enjoy the convenience of various small appliances, such as microwave ovens, TV sets, etc., when away from a marina, the use of on board motor/generator sets has grown in popularity. However, because of space considerations, such motor/generator sets have been limited for use in marine craft exceeding about 30 feet in length. Generally speaking, these larger craft have sufficient space available in the bilge or engine compartment area in which a motor/generator set can conveniently be placed. However, in the case of pleasure craft of a length less than about 30 feet, all available space is already used up by the engine compartment and living space so that it is most often not possible to utilize prior art motor/generator sets.

The motor/generator set of the present invention obviates this problem. In particular, the motor/generator set of the present invention is extremely compact and is housed in a waterproof enclosure, that can attach directly to the motor/generator allowing it to be mounted exterior to the hull such as on a conventional swim platform. Alternately, the waterproof enclosure or housing can be designed into the swim platform by the boat manufacturer as a containment for the compact motor/generator set. Such a swim platform is found on most pleasure craft as a horizontal rearward extension from the transom and it is located just above the waterline of the boat. Furthermore, because of its compact configuration, it is sometimes possible to locate the motor/generator set within the hull in the bilge area of these smaller marine craft.

SUMMARY OF THE INVENTION

In accordance with the preferred embodiment of the invention, there is provided a four-cycle, two-cylinder water-cooled internal combustion engine having an overhead cam arrangement for operating the valves which allows the intake manifold and the exhaust manifold to be disposed on opposite sides of the cylinder head. This internal combustion engine is mounted upon a support plate with its crankshaft vertical. Also mounted on the support plate closely adjacent to the internal combustion engine is an AC generator which, when driven at 3600 rpm produces a 120 volt, 60 Hz, 3 Kw supply. The armature shaft of the generator is oriented parallel to the crankshaft of the engine. Coupled to the exhaust manifold of the engine is a muffler which is also supported by the mounting plate. The mounting plate also supports one or more water pumps and both the generator and the water pump(s) are driven by the engine's shaft. In fresh water applications, a single water pump is effective to circulate cooling water through the engine's oil pan, through its cylinder head and through the muffler to thereby maintain these components at an acceptably low temperature. A fan or impeller is located on the drive shaft of the generator.

The assembly thus far described fits within a box-like housing having air inlet and outlet ports shielded by a labyrinthian path whereby combustion air for the engine and cooling air for the generator can be brought into the otherwise sealed enclosure without admitting splash water. The box-like housing is sufficiently sturdy to function as a step on the swim platform.

In accordance with one feature of the invention, where the marine craft is to be used in salt-free water, a single water pump draws floatation water and routes it to the engine and muffler as described. Where the craft is to be used in sea water, provision is made for a heat exchanger whereby fresh water or a water/antifreeze mixture is circulated through the engine with the heat exchanger surface being cooled by the floatation water. Here, two water pumps may be used, one for circulating the salt-free cooling water and one for circulating the floatation water.

OBJECTS

It is accordingly a principal object of the present invention to provide a new and improved motor/generator set for use on marine craft.

Another object of the invention is to provide a motor/generator set which is designed to be sufficiently light in weight and compact to be mounted either external to or internal of the craft's hull.

Yet another object of the invention is to provide a motor/generator set for marine applications which can be totally enclosed in a water-tight box or shroud and whose heat-radiating surfaces are maintained at a relatively low temperature by a water-cooling system, permitting a relatively small size muffler to be used and which allows air-cooling of the generator within the shroud.

The foregoing objects, features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE DRAWINGS

FIG. 1 is a side view of a marine craft showing the positioning of the motor/generator set on a swim platform;

FIG. 2 is a front view of the motor/generator set with the cover removed as observed from the location 2—2 in FIG. 1;

DESCRIPTION OF THE PREFERRED EMBODIMENT

Figure 3:
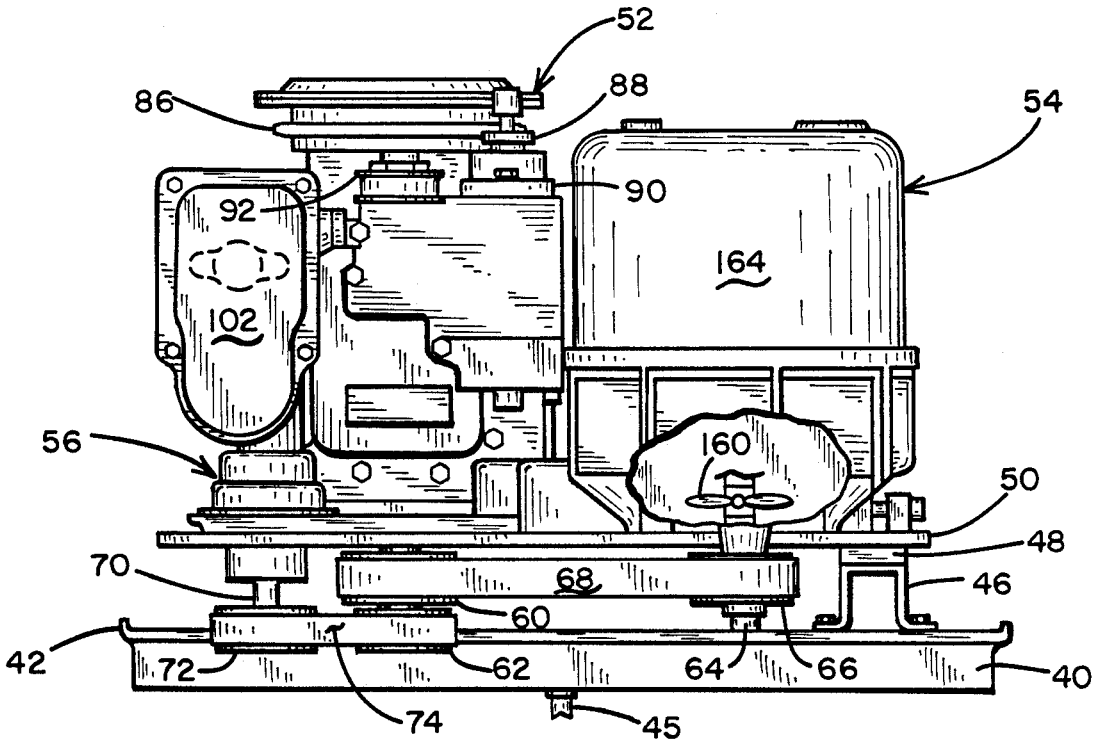
FIG. 3 is a rear view of the motor/generator set with the cover removed taken from the position 3—3 in FIG. 1.

Referring first to FIG. 1, the general arrangement of the motor/generator set of the present invention is illustrated. Identified by numeral 10 is the aft portion of a marine craft 10 which has a transom 12 from which is supported a swim platform 14. Bolted or otherwise affixed to the swim platform 14 is the motor/generator set here indicated generally by numeral 16. Passing through a seal plate in the transom 12 and indicated by numeral 18 is a fuel line leading from the fuel tank of the craft 10 to the fuel pump of the internal combustion engine of the motor/generator set 16. Numeral 18 also refers to the electrical cables which pass through the transom 12 to deliver current to the starter motor of the motor/generator set to control its start/stop functions and to the AC power output lines from the generator of the motor/generator set 16 leading back to the craft 10.

Extending downward from the swim platform 14 below the water line 20 is a cooling water intake line 22 and an exhaust/cooling water outlet pipe 24. As will be described in considerably more detail hereinbelow, in fresh water applications, the floatation water may be used as the cooling medium. However, in salt water applications, a suitable heat exchanger arrangement, which is identified in FIG. 1 by numeral 26, is called for. It is seen to include a tubular plastic jacket 28 attached to the transom 12 by a bracket 30 and extending downward and forward from the jacket 28 is a ram tube 32 which is effective to scoop floatation water and force it through the jacket 28 when the craft is in motion. The jacket 28 surrounds a tubular copper coil (not shown in FIG. 1) and, as such, the surface of that coil is continually flooded by seawater. With continued reference to FIG. 1, identified by numerals 34 and 36, are the heat exchanger coil inlet and outlet connections which complete a circuit between a water pump and the internal combustion engine utilized in the motor/generator set 16. This circuit is filled with fresh water or a suitable antifreeze/water mixture. The jacket 28 also has an outlet tube 38 joined to it which leads to a second water pump and from there to the muffler associated with the internal combustion engine, all as will be more particularly described below.

With reference next to the views of FIGS. 2–6, a description will be given of the constructional features of the motor/generator (M/G) set comprising the preferred embodiment of the present invention. FIG. 2 is a rear view of the assembly with the cover 17 of FIG. 1 removed. The assembly is seen to include a lower base plate 40 which is adapted to be fastened to the swim platform 14 when the M/G set is mounted external to the hull of the water craft 10 and to a suitable horizontal surface in the bilge area of the hull when the M/G set is to be located inboard. The base plate 40 has an upwardly turned lip 42 around the periphery thereof and the lip is suitably formed to create a flange 44 for receiving the lower edges of the box-like cover 17 therein. A suitable elastomeric gasket 19 (FIG. 1) is disposed around the open base of the housing 17 and cooperates with the flange area 44 on the base plate 40 to create a water-tight seal when the cover is latched in place. Alternatively, the compact motor/generator can be installed into a water-tight housing integrally formed directly onto the swim platform where that housing incorporates the sealing features described above. The base plate 40 is also equipped with an automatic drain valve 45 of the type that allows any condensation or splash water that may enter during servicing to escape, but prevents ingress of any floatation of water. A Neoprene® "flapper" valve manufactured by Tempo Products Co. of Cleveland, Ohio, works well in this application and is disposed at a low point in the base plate 40 which functions as a collection sump.

Bolted to the baseplate 40 at appropriate locations are shock-mounting brackets 46 which include a resilient rubber cushion 48 thereon and resting atop the rubber cushions of the shock-mounting support brackets is an equipment mounting plate 50. In this fashion, engine vibration and the like is effectively isolated from the swim platform and hull, thus promoting quieter operation.

With reference to FIGS. 2 and 3, it can be seen that there is attached to the equipment mounting plate 50 an internal combustion engine indicated generally by numeral 52, an electrical generator identified by numeral 54, a water pump 56 and an exhaust muffler 58. The internal combustion engine 52 is oriented with its shaft vertical and it passes through an opening provided in the mounting plate 50 and secured to its lower end between the equipment mounting plate 50 and the base plate 40 are first and second drive pulleys 60 and 62. The generator 54 is positioned closely adjacent to the engine 52 and it, too, has its driven shaft 64 passing through an opening formed through the thickness dimension of the mounting plate 50. A pulley 66 is secured to the shaft 64 and a drive belt 68 extends between the drive pulley 60 of the engine and the driven pulley 66 on the generator. In a somewhat similar fashion, the water pump 56 has its shaft 70 extending through the mounting plate 50 and affixed to the shaft 70 is a driven pulley 72. A drive belt 74 couples the drive pulley 62 of the engine to the water pump's driven pulley 72.

With continued reference to the internal combustion engine 52, it is seen to include a crankcase 74 which is generally located beneath the engine and below the mounting plate 50. A dip stick 76 is provided for measuring oil level therein with oil being added through fill port 78 and drained by removing the drain plug 80.

Disposed atop the cylinder block 82 (FIG. 5) is the engine's flywheel 84. It has a ring gear 86 meshing with the pinion gear 88 of a starter motor 90.

The internal combustion engine 52 preferably employs an overhead valve assembly and, as such, has a toothed pulley 92 attached to its driveshaft and a cog belt 94 couples that pulley to an associated overhead cam pulley 96, whereby the opening and closing of the overhead valves are maintained in timed relationship with the rotation of the engine's crankshaft. The advantage of using an overhead valve and cam arrangement is that it allows the exhaust manifold 98 (FIG. 5) to be positioned on the opposite side of the cylinder block from the engine's intake manifold (not shown). As such, there is room to position the engine's carburetor 100 on one side of the cylinder block and the muffler 58 on the opposite side and immediately adjacent the engine's exhaust manifold 98. The air cleaner and flame arrester cover is identified by numeral 102 for purposes of reference and likewise, the fuel pump 104 (FIG. 2) is illustrated for a similar purpose.

Figure 5:
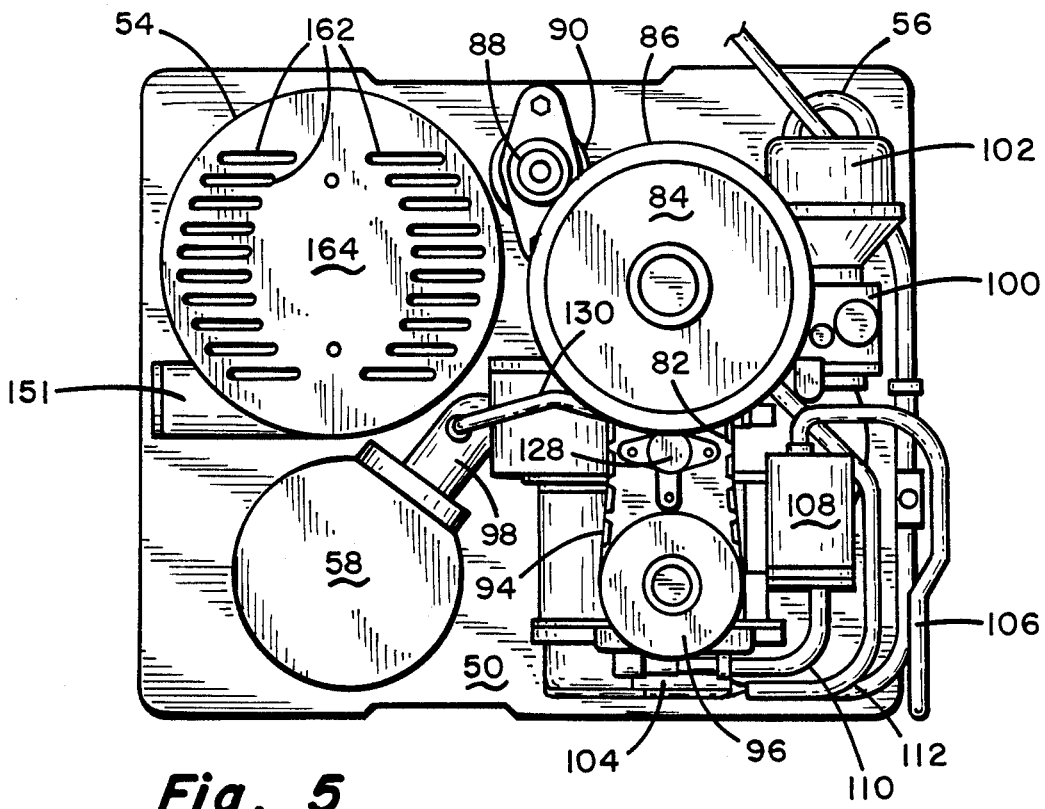
FIG. 5 is a plan view taken along the line 5—5 in FIG. 2.

In reference to FIGS. 2 and 5, numeral 106 identifies the fuel line which passes through the transom 12 of the boat and which enters the fuel pump 104 via fuel filter 108 and fuel line 110. Fuel line 112 comes from the outlet of the fuel pump 104 and delivers fuel to the carburetor 100.

Figure 6:
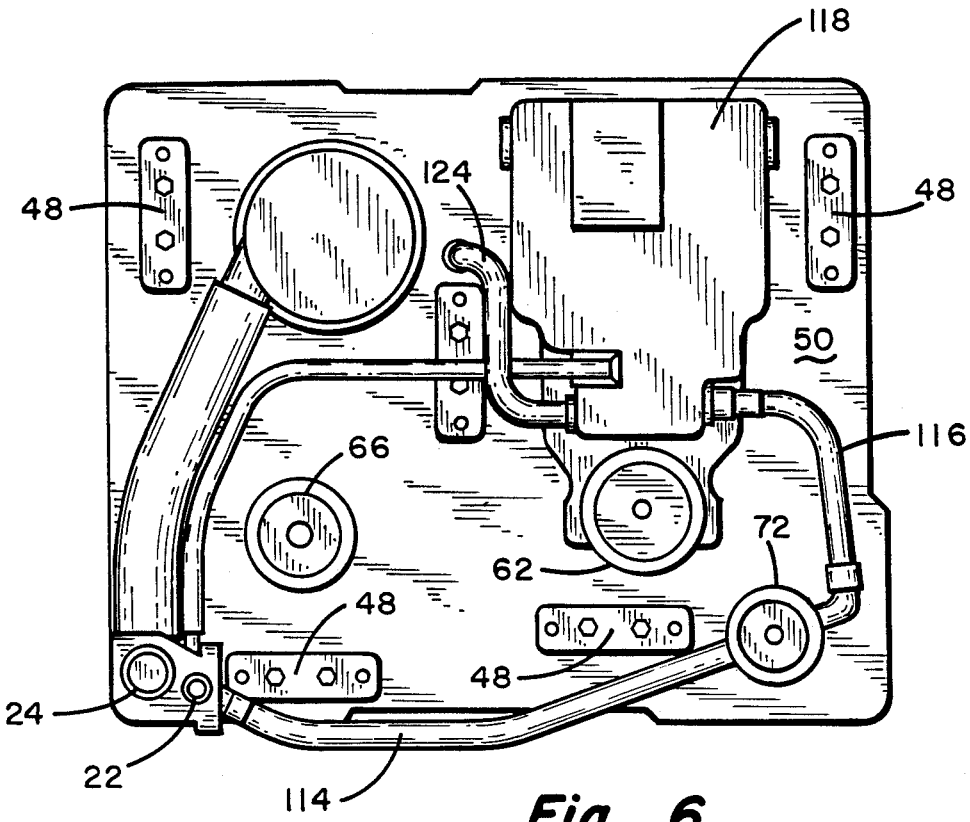
FIG. 6 is a bottom view taken along the line 6—6 in FIG. 2.

With reference to the bottom view of FIG. 6, it can be observed that in addition to the belts and drive pulleys used to connect the engine's shaft to the water pump and to the generator, various hoses forming part of the water cooling system of the M/G set are also disposed in the spacing between the baseplate 40 and the mounting plate 50. Specifically, a hose 114 connects the fresh water inlet tube 22 to the water pump's inlet (not shown). The outlet from the water pump is connected by way of hose 116 to the engine's oil pan 118 bolted to the bottom of the engine's crankcase 74. This crankcase is shown in partially sectioned form in the view of FIG. 4 and is seen to include an oil reservoir or chamber 118 sealed by a drain plug 80. Disposed immediately behind the drain plug is an oil filter cartridge 82 which can be extracted through the drain hole for replacement. Immediately adjacent a longitudinal wall 120 of the oil pan and in heat transfer relation to it is a chamber 122 to which the hose 116 connects. Thus, the flow of cooling water through this chamber serves to extract heat from the oil in the crankcase oil pan 118 to reduce its temperature. A bypass hose 124 is used to couple the chamber 122 to a water inlet port of the muffler 58.

Figure 4:
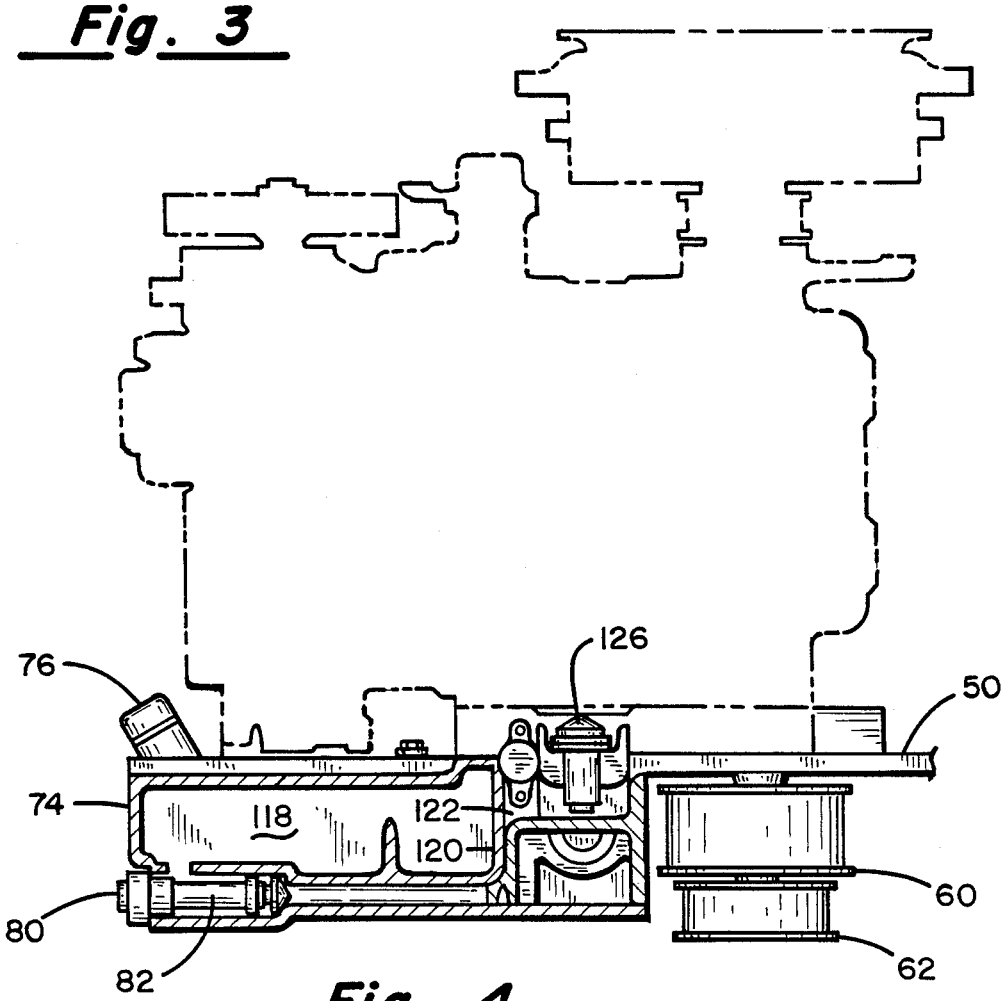
FIG. 4 is a side elevation detailing the water-cooled oil pan and taken along line 4—4 in FIG. 2.

While not shown in the drawings, the engine includes cooling water passageways leading from the chamber 122 to the engine's cylinder head and disposed in this passageway is a pressure relief valve 126 (FIG. 4). This pressure relief valve is configured so that at low engine rpm or at idle, the valve 126 permits cooling water to flow from the chamber 122 through the internal passageways of the engine and through a thermostat contained in thermostat housing 128 and hose 130 to the exhaust manifold 98. At higher speeds, however, the increased pressure generated by the water pump 56 operates the valve 126 to bypass a portion of the cooling water through the hose 124 directly to the muffler. It is to be understood, however, that a flow of cooling water is still maintained through the internal passageways of the engine and via the thermostat 128 to the exhaust manifold 98.

By cooling the muffler and the exhaust gases passing through it, the volume of these gases are drastically reduced. As such, the size of the muffler necessary to quiet the engine can be significantly reduced from what would otherwise be required. Furthermore, by extracting the heat in the exhaust, up to 60% of the heat which would otherwise build up in the sealed M/G set housing (FIG. 1) is effectively removed. The amount of heat radiated from the engine block itself is maintained at a reasonable level by the engine cooling system and is principally controlled by the opening temperature of the thermostat 128.

Figure 7:
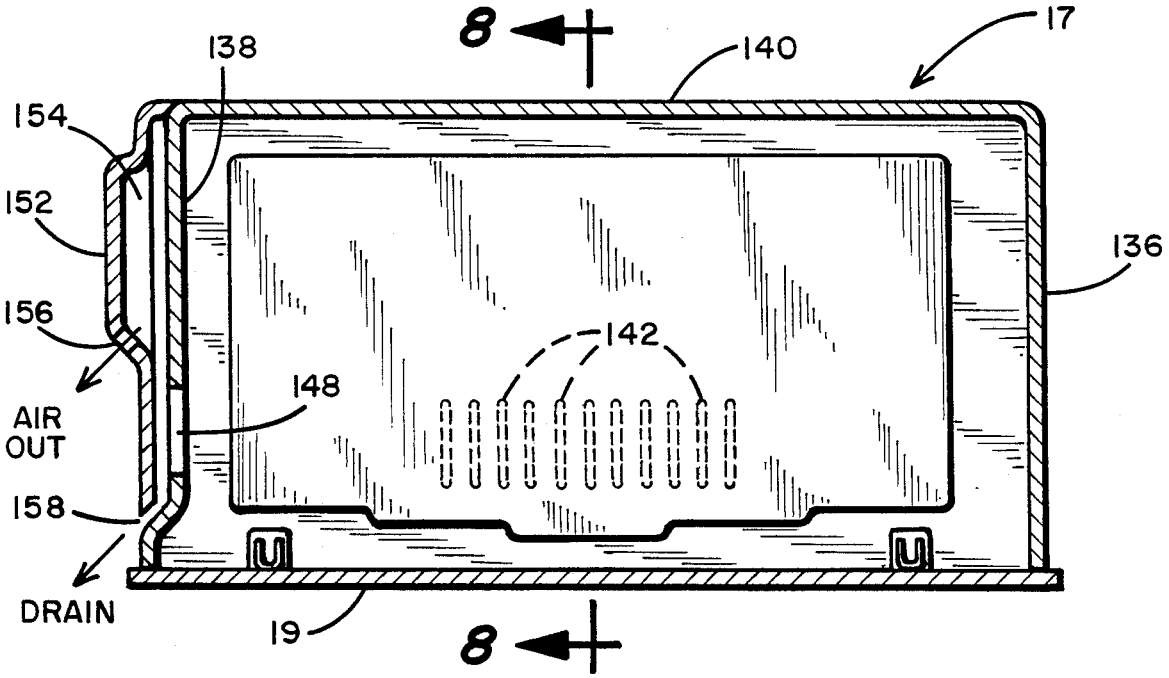
FIG. 7 is a cross-sectional view taken along the line 7—7 in FIG. 1.
Figure 8:
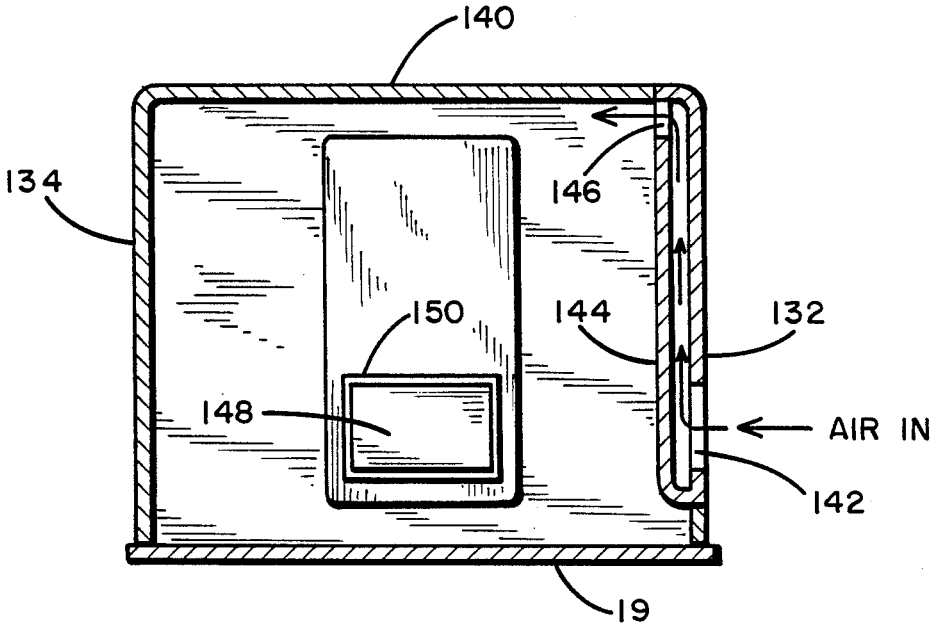
FIG. 8 is a further cross-sectional view of the cover taken along the line 8—8 in FIG. 7.

Because the temperature of the air drawn into the enclosure or housing 17 does not become excessively heated, it may be used as a cooling medium for the generator 54 as well as serving as the combustion air for the engine. More particularly, and with reference to FIGS. 1, 7 and 8, the M/G set enclosure 17 comprises a front wall 132, a rear wall 134, a right side wall 136, a left side wall 138 and a top wall 140. The front, rear and side walls terminate in an open bottom which is designed to fit within the lip 42 of the base plate 40. Formed through the thickness dimension of the front wall 132 are a series of slots, as at 142, through which air may enter. Blocking the air entry louvers 142 is a baffle plate 144 which extends upward but falls short of the top wall 140. As such, an elongated slot 146 is created through which incoming air may pass. The baffle plate 144 effectively precludes splash water from flowing into the interior of the enclosure. Furthermore, by positioning the air inlet in the front wall 132, it is less subject to having splash water impinge on it in that this wall 132 is close to the transom 12 and above the swim platform 14 and is thus sheltered from most wave action.

An opening 148 is formed through the left wall 138 of the housing 17 and this opening 148 is surrounded by an elastomeric gasket 150 which effectively seals it to the blower outlet 151 of the generator 54 (FIG. 5). Attached to the left side wall 138 is a cover plate 152 which effectively blocks the outlet 148 forcing the air to rise into the plenum area 154 and thence through an elongated slit 156 to the outside. Any splash water tending to enter the slit 156 will flow down in the space between the plate 152 and the wall 138 and will exit a drain opening 158. This, too, serves to prevent any substantial amount of water from entering the M/G set enclosure to the point where it might result in engine or generator malfunction.

Cooling air is drawn in through the inlet louvers 142 by the pumping action of the engine'cylinders as well as by an impeller or fan 160 secured to the lower portion of the generator's drive shaft (see FIG. 3). The rotation of this impeller draws the cooling air through the louvers 162 formed in the generator housing 164. This air, driven by the impeller 160 then passes through the blower output connection 151 which, as mentioned, is sealingly disposed within the opening 148 in the housing side wall 138. The equipment housing 17 is fabricated and reinforced such that it can support the weight of an adult person and, hence, can function as a step when ascending from the swim platform to the top of the transom upon entering the craft.

Figure 9:
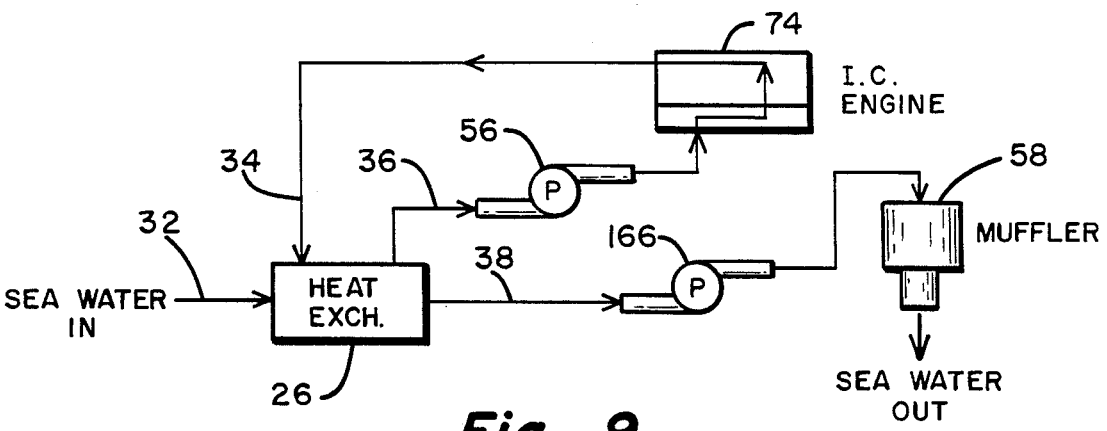
FIG. 9 is a schematic diagram of the cooling system for marine applications.
Figure 10:
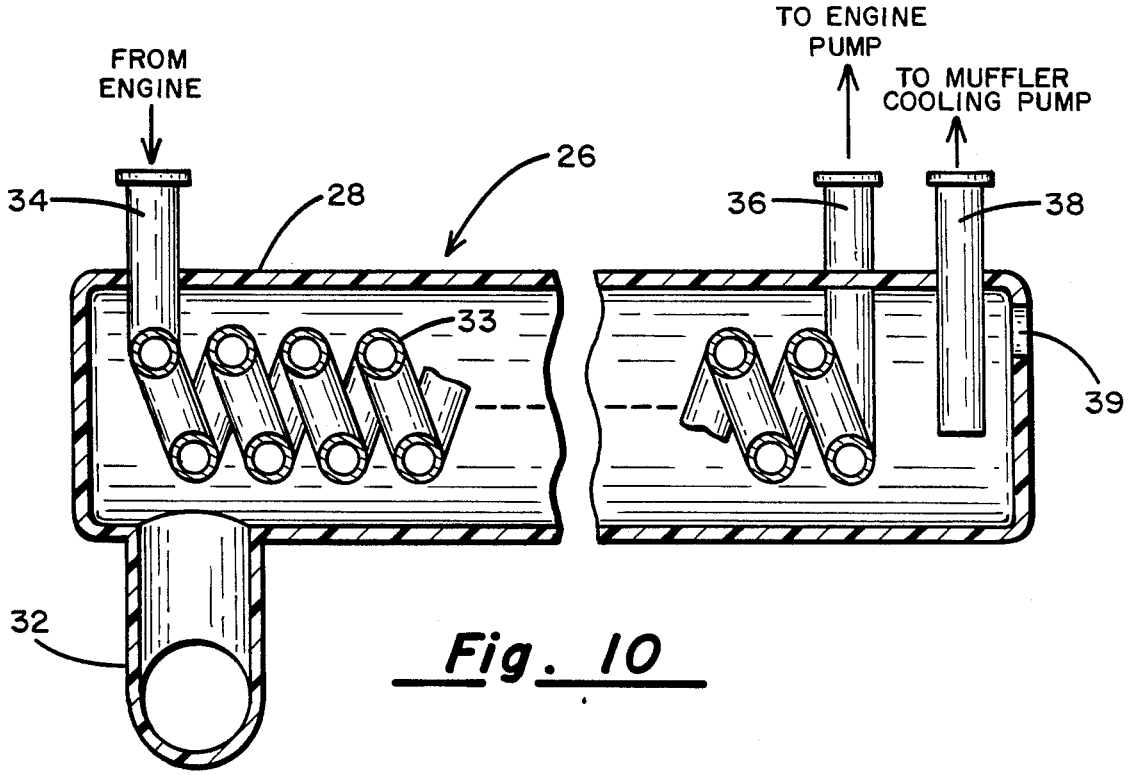
FIG. 10 is a cross-sectional view showing the heat exchanger used with saltwater craft.
Figure 11:
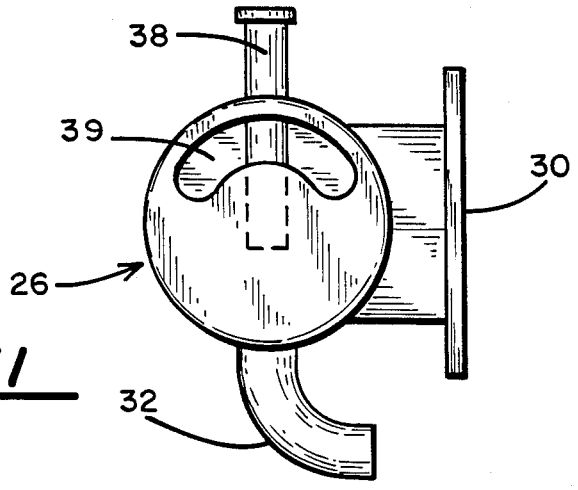
FIG. 11 is an end view of the heat exchanger of FIG. 10.

Brine, being corrosive to most metals, cannot be directly circulated through the engine's oil pan and engine block cooling ducts and, therefore, as mentioned earlier, a heat exchanger 26 is utilized. As shown in FIGS. 10 and 11, it includes an outer molded tubular plastic jacket 28 mounted on the transom and having a ram inlet 32 facing forward for scooping water during the forward movement of the craft. The seawater floods the interior of the hollow plastic jacket 28 and contained within the jacket is a heat exchanger coil 33 having an inlet connection 34 and an outlet connection 36. A coolant, such as pure water or water mixed with antifreeze, is made to flow through the circuit including the coil 33 and seawater is only used to extract heat energy from the coil and to cool the engine's muffler. FIG. 9 illustrates schematically the cooling system involved when the motor/generator set of the present invention is to be used with seawater. The heat exchanger 26 has a seawater inlet 32 and an outlet 38 coupled through an impeller pump 166 to the muffler 58 where it is returned to the sea and a pressure relief port 39 to vent excess pressure while underway. The fresh water flowing through the coil's outlet 36 connects to the inlet of the water pump 56 whose outlet connects to the chamber 122 in the engine's oil pan 74 and thence through the cylinder block and head cooling water passageways and the thermostat back to the heat exchanger's inlet connection 34.

Those skilled in the art will understand that the coolant coils 33 must remain flooded with cooling water at all times. When the marine craft is at rest, operation of the impeller pump 166 creates a suction via port 38 to draw seawater through the ram tube 32 and this flow is assisted by convection from the cold water inlet to the hot water outlet. The pressure relief port 39 formed in the end wall of the heat exchanger jacket 28 has approximately the same cross-sectional area as that of the ram inlet 32 and thus insures that there will be no excess pressure buildup which might otherwise force cooling water through the port 38, flooding the pump 166 and the muffler 58.

The M/G set of the present invention is not limited in its application to mounting external to the hull of the craft. Where space permits, the compact M/G set, within its enclosure 17, may be bilge mounted, i.e., within the hull. Because the motor/generator set of the present invention has its own internal blower, i.e., the blower or fan 160 associated with the generator unit, it is able to exhaust itself to the bilge area where the craft's own conventional bilge blowers can remove any combustible fumes. Furthermore, by providing suitable safety circuits, it can be guaranteed that the craft's bilge blowers will be operated a predetermined length of time before a circuit can be completed to the starter of the motor/generator's engine.

Moreover, it has been found convenient to install other safety devices on the motor/generator's engine. In particular, a high water temperature sensor (not shown) is provided for shutting down the engine when the water temperature becomes excessive. This may be occasioned by poor water circulation due to a failure of the water pump 56 or a blockage of the cooling water intake pipe. Similarly, a low oil pressure sensor may be incorporated to again shut down the motor/generator's engine in the event of oil pump failure or lack of oil in its crankcase. Also, it has been found expedient to incorporate a high exhaust temperature sensor to effect engine shutdown in the event that the flow of cooling water to the muffler is insufficient.

The control circuitry associated with the aforementioned sensors may conveniently be disposed in a small metal box 168 mounted directly above the muffler 58 as illustrated in the side elevation of FIG. 2.

By utilizing a two cylinder, 7-horsepower vertical shaft internal combustion engine operating at approximately 3000 rpm and driving an air cooled AC generator with the respective drive and driven pulleys sized so as to run at 3600 rpm, a 3 kilowatt 120 volt A.C. supply is provided. If both the engine and the generator are operated at 3600 rpm, the power output rises to approximately 4.2 kilowatts. The entire system fits within an enclosure 17 which is only 20 in. long, 15 in. wide and 15 in. high. The unit in accordance with the present invention weighs a mere 155 lbs. and it is believed to be the smallest, two-cylinder, marine motor/generator set of the specified output ever produced.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A motor/generator set for providing auxiliary electrical power to a marine craft, said marine craft being of the type having a hull with a transom extending across the aft portion thereof and with platform means extending rearwardly from said transom, the combination comprising:

(a) supporting means adapted to be attached to said platform means;

(b) a water-cooled, internal combustion engine supported by said supporting means and having a combustion air intake means, an exhaust gas discharge means and means for intaking water from a surrounding water body;

(c) an electrical power generator supported by said supporting means and having a power output means;

(d) means for operatively coupling said engine and said generator;

(e) enclosure means for sealingly enclosing said engine and said generator from exposure to said surrounding water body; and (f) means for communicating each of said air intake means, said exhaust gas discharge means and water intake means and said power output means outside of said enclosure means without impairing the sealing condition provided by said enclosure means.

2. The motor/generator set as in claim 1 wherein said supporting means comprises:

(a) a lower base plate affixed to said platform means;

(b) an upper equipment mounting plate supporting said engine and said electrical power generator; and (c) means for resiliently shock mounting said upper equipment mounting plate to said lower base plate.

3. The motor/generator set as in claim 2 wherein said means operatively coupling said engine and said generator is disposed between said lower base plate and said upper equipment mounting plate.

4. The motor/generator set as in claim 1 wherein said means for intaking water from a surrounding water body passes through said enclosure.

5. The motor/generator set as in claim 1 wherein said enclosure means includes a cover sealingly joined to said supporting means.

6. The motor/generator set as in claim 5 wherein said combustion air intake means is exposed to ambient air through vent means formed in said cover.

7. The motor/generator set as in claim 6 and further including means in said cover for blocking entry of water splashed from said water body through said vent means.

8. The motor/generator set as in claim 1 and further including:

(a) an exhaust muffler supported by said supporting means and having an inlet connected to said exhaust gas discharge means of said engine and an outlet;

(b) means coupling said water intake means to said exhaust muffler for cooling the exhaust gases; and (c) means passing through said enclosure means for discharging the cooled exhaust gases and the cooling water to the exterior of said cover.

9. A motor/generator set for providing auxiliary electric power to a marine craft of the type having a hull with a transom across the aft portion thereof and a horizontal swim platform projecting rearward from said transom at an elevation immediately above the water line on said hull wherein said motor/generator set is contained in a box-like enclosure substantially impervious to the undesired influx of floatation water and is affixed to said swim platform.

10. A compact motor/generator set for providing auxiliary electrical power to a marine craft, said marine craft being of the type having a hull including a transom, the combination comprising:

(a) a base plate adapted to be attached to said marine craft in a generally horizontal disposition;

(b) a mounting plate resiliently supported in parallel, spaced relation above said base plate;

(c) a water-cooled internal combustion engine secured to said mounting plate, said engine having a vertically oriented shaft, a combustion air intake means and an exhaust gas manifold;

(d) water pump means secured to said mounting plate, said water pump means including a vertically disposed shaft, a water suction inlet and a water outlet, said water suction inlet being coupled to a source of cooling water, said water outlet being coupled to said engine;

(e) an electrical power generator attached to said mounting plate and having a vertically oriented shaft supporting armature windings for rotation within surrounding stator windings and an impeller secured to said shaft at a location beneath said armature windings;

(f) means for operatively coupling said shaft of said engine in driving relation to said shaft of said water pump means and to said shaft of said generator; and (g) a removable box-like cover having four mutually orthogonal vertical side walls, a top wall and an open bottom, said removable cover being mounted on said base plate and forming an enclosure for said engine, said water pump means and said generator, said cover including an opening in at least one of said vertical side walls and a labyrinth path joining said opening to the interior of said enclosure, whereby combustion air for said engine and cooling air for said generator is drawn into said enclosure by rotation of said impeller on the shaft of said generator while splash water is blocked from entering said enclosure by said labyrinth path.

11. The motor/generator set as in claim 10 and further including a muffler attached to said mounting plate and having an exhaust inlet attached to said exhaust gas manifold of said engine and an exhaust and cooling water outlet extending through said enclosure to a location exterior to said enclosure, said water outlet of said water pump means being in fluid communication with said muffler for delivering cooling water to and extracting heat from said muffler.

12. The motor/generator set as in claim 11 wherein said combustion air intake means and said exhaust gas manifold of said engine are on opposed side surfaces of said engine.

13. The motor/generator set as in claim 11 wherein said engine, said generator and said muffler are disposed in close, side-by-side relation to one another on said mounting plate, said muffler being directly adjacent said exhaust gas manifold of said engine.

14. The motor/generator set as in claim 11 wherein said source of cooling water comprises a heat exchanger coil.

15. The motor/generator set as in claim 14 wherein said heat exchanger coil is connected in circuit with said water suction inlet, said engine and said water outlet.

16. The motor/generator set as in claim 15 and further including a water jacket surrounding said coil, said water jacket including a ram tube extending below the water line of said marine craft into the floatation water for directing said floatation water into said jacket when the marine craft is in motion, said water jacket further including a water outlet coupled in fluid communication with said muffler.

17. The motor/generator set as in claim 10 and further including a louvered shroud surrounding said stator windings for routing cooling air through said louvers and over said stator windings and armature windings.

18. The motor/generator set as in claim 10 wherein said engine includes a crank case including an oil pan, said oil pan including a passageway internal to a wall surface thereof; and means for routing cooling water delivered by said water pump means to said passageway.

19. The motor/generator set as in claim 10 wherein said base plate is attachable to a surface exterior to said hull of said marine craft.

20. The motor/generator set as in claim 19 wherein said surface exterior to said hull of said marine craft is a swim platform secured to said transom of said marine craft.

21. The motor/generator set as in claim 20 wherein said removable cover is constructed to support the weight of a person using said cover as a step in climbing from said swim platform over said transom.

22. The motor/generator set as in claim 10 and further including a water-tight seal member surrounding said open bottom of said cover for cooperating with the edge area of said base plate.

23. The motor generator set as in claim 10 wherein the lower end portions of said shafts of said engine, said water pump means and said generator extend through openings in said mounting plate and wherein said means for operatively coupling said shaft of said engine in driving relation to said shaft of said generator is located between said base plate and said mounting plate.

24. The motor/generator set as in claim 10 wherein said source of cooling water comprises an elongated tube extending into the floatation water for said marine craft.

* * * * *